US008966681B2

(12) United States Patent
Burch

(10) Patent No.: US 8,966,681 B2
(45) Date of Patent: Mar. 3, 2015

(54) EXERCISE MAT

(71) Applicant: Linda L. Burch, Bellevue, WA (US)

(72) Inventor: Linda L. Burch, Bellevue, WA (US)

( * ) Notice: Subject to any disclaimer, the term of this patent is extended or adjusted under 35 U.S.C. 154(b) by 0 days.

(21) Appl. No.: 14/150,691

(22) Filed: Jan. 8, 2014

(65) Prior Publication Data

US 2014/0237718 A1 Aug. 28, 2014

Related U.S. Application Data

(60) Provisional application No. 61/769,537, filed on Feb. 26, 2013.

(51) Int. Cl.
*A47G 9/06* (2006.01)
*A63B 21/00* (2006.01)

(52) U.S. Cl.
CPC ..... *A63B 21/1473* (2013.01); *Y10S 5/907* (2013.01)
USPC ..... 5/417; 5/420; 5/907; 482/23

(58) Field of Classification Search
CPC ..... A47G 27/0237; A63B 21/1473
USPC ..... 5/417, 420, 482, 907; 482/23
See application file for complete search history.

(56) References Cited

U.S. PATENT DOCUMENTS

| | | | | |
|---|---|---|---|---|
| 4,117,337 | A | 9/1978 | Staats | |
| 5,419,706 | A | 5/1995 | Levy et al. | |
| 6,387,013 | B1 | 5/2002 | Marquez | |
| 7,108,635 | B2 * | 9/2006 | Howlett-Campanella | 482/23 |
| 7,465,090 | B2 | 12/2008 | Haras | |
| 7,465,263 | B1 | 12/2008 | Conrad et al. | |
| 7,819,777 | B1 | 10/2010 | Service | |
| 8,025,606 | B2 * | 9/2011 | Hamilton | 482/4 |
| 8,130,384 | B2 | 3/2012 | Kindlein et al. | |
| 8,162,852 | B2 | 4/2012 | Norris | |
| 8,317,660 | B2 * | 11/2012 | Goranson | 482/23 |
| D688,068 | S * | 8/2013 | Ntoukas | D6/587 |
| 8,499,383 | B1 * | 8/2013 | Ungaro | 5/417 |
| 2002/0044631 | A1 | 4/2002 | Graumann et al. | |
| 2004/0214692 | A1 * | 10/2004 | Koenig | 482/23 |
| 2004/0229731 | A1 | 11/2004 | Mitchell | |
| 2006/0183096 | A1 | 8/2006 | Riener et al. | |
| 2007/0088232 | A1 * | 4/2007 | Corradini | 601/28 |
| 2007/0189456 | A1 | 8/2007 | Haras | |
| 2007/0225550 | A1 | 9/2007 | Gattani et al. | |
| 2007/0247422 | A1 | 10/2007 | Vertegaal et al. | |
| 2007/0275827 | A1 * | 11/2007 | Glaser | 482/23 |
| 2009/0181836 | A1 * | 7/2009 | Schneider | 482/140 |
| 2009/0316965 | A1 | 12/2009 | Mailling et al. | |
| 2010/0198112 | A1 | 8/2010 | Maad | |
| 2012/0281809 | A1 | 11/2012 | Graumann et al. | |
| 2013/0180048 | A1 * | 7/2013 | Saltzman | 5/417 |
| 2014/0007345 | A1 * | 1/2014 | Hasta | 5/417 |
| 2014/0259398 | A1 * | 9/2014 | Kendall | 5/420 |

* cited by examiner

*Primary Examiner* — Michael Trettel
(74) *Attorney, Agent, or Firm* — Roeder & Broder LLP; James P. Broder

(57) ABSTRACT

A mat (10) comprises an origin (54) that is positioned along one of a first axis (12F) and a second axis (12S); a first indicia that is positioned symmetrically relative to the origin (54); and a second indicia that is positioned symmetrically relative to only one of the axes. The first indicia can include a plurality of longitudinal lines (28) that are substantially parallel to one another. The plurality of longitudinal lines (28) can include (i) a longitudinal centerline (32), (ii) a pair of first longitudinal lines (34) that are equally spaced on either side of the longitudinal centerline (32), (iii) a pair of second longitudinal lines (36) that are equally spaced on either side of the longitudinal centerline (32), and (iv) a pair of third longitudinal lines (38) that are equally spaced on either side of the longitudinal centerline (32).

21 Claims, 4 Drawing Sheets

EXERCISE MAT

RELATED APPLICATION

This application is related to and claims domestic priority under 35 U.S.C. §119(e) from U.S. Provisional Application Ser. No. 61/769,537, filed Feb. 26, 2013, entitled "HARMONIC MAT". As far as permitted, the contents of U.S. Provisional Application Ser. No. 61/769,537 are incorporated herein by reference.

BACKGROUND

Harmonic patterns are present in all living forms. One belief is that a living being is in fact a resonating liquid crystal made mostly of carbon and water, becoming more coherent and more focused as it rides on the Earth through space. For example, a living body focuses energy between its two reflecting halves; thus, becoming more harmonically tuned over time. Additionally, body-centered techniques through spatial movement are considered by some to be the first principle of evolution by focusing life toward greater efficiency, greater mobility, greater balance, greater intelligence and ultimately greater consciousness. Further, mathematical and geometrical measurements and proportions of the human body are important aspects for improving precise body alignment.

The spine represents an axis of resonance in the human body. Additionally, the measurement of a person's height and the distance between the floor and the person's navel yields a value that is close to a "golden ratio", which represents true biological proportions. More specifically, the average human body has a ratio of height to distance between the ground and the person's navel of approximately 1.618. By way of calculation, the distance from the ground (or the bottom of the feet) to the navel can be referred to as the "long measure", and the distance from the navel to the top of the head can be referred to as the "short measure". In the average person, the ratio of the long measure to the long measure plus the short measure (or to the full height of the person) is approximately 1.618. Stated in another manner, if the long measure is said to be equal to one unit of measure; then the full height of the average human body can be equated to approximately 1.618 units of measure.

Based on the proper understanding of these concepts, it is desired to provide a harmonic mat (also referred to herein as an "exercise mat", or simply a "mat") that can help increase the likelihood that the human body can be maintained in precise body alignment in order to enhance and/or promote health and well being, as well as function as a training aid for its users.

SUMMARY

The present invention is directed toward a mat including a first surface, the first surface having a first axis and a second axis that is orthogonal to the first axis. In certain embodiments, the mat comprises an origin that is positioned along one of the axes; a first indicia that is positioned on the first surface, the first indicia being positioned symmetrically relative to the origin; and a second indicia that is positioned on the first surface, the second indicia being positioned symmetrically relative to only one of the axes.

In some embodiments, the mat further comprises a first edge and an opposed second edge. In such embodiments, the first indicia can include a plurality of longitudinal lines that extend substantially from the first edge to the second edge, the plurality of longitudinal lines being substantially parallel to one another. The plurality of longitudinal lines include at least (i) a longitudinal centerline, (ii) a pair of first longitudinal lines that are equally spaced on either side of the longitudinal centerline, (iii) a pair of second longitudinal lines that are equally spaced on either side of the longitudinal centerline, and (iv) a pair of third longitudinal lines that are equally spaced on either side of the longitudinal centerline.

In some such embodiments, (i) the longitudinal centerline includes a first identifier, (ii) the pair of first longitudinal lines include a second identifier that is different than the first identifier, (iii) the pair of second longitudinal lines include a third identifier that is different than the first identifier and the second identifier, and (iv) the pair of third longitudinal lines include a fourth identifier that is different than the first identifier, the second identifier and the third identifier. For example, each identifier can be a color that is different from one another. Stated in another manner, the first identifier can be a first color, the second identifier can be a second color, the third identifier can be a third color, and the fourth identifier can be a fourth color, with each of the first color, the second color, the third color and the fourth color being different from one another. In one embodiment, (i) the longitudinal centerline is red, (ii) the pair of first longitudinal lines are orange, (iii) the pair of second longitudinal lines are yellow, and (iv) the pair of third longitudinal lines are green. Additionally and/or alternatively, (i) the first identifier can be a first alphanumeric symbol that is positioned substantially adjacent to an end of the longitudinal centerline, (ii) the second identifier can be a second alphanumeric symbol that is positioned substantially adjacent to an end of the pair of first longitudinal lines, (iii) the third identifier can be a third alphanumeric symbol that is positioned substantially adjacent to an end of the pair of second longitudinal lines, and (iv) the fourth identifier can be a fourth alphanumeric symbol that is positioned substantially adjacent to an end of the pair of third longitudinal lines.

In one embodiment, the mat further comprises a plurality of transverse lines that are substantially equally spaced apart from and substantially parallel to one another, the plurality of transverse lines being substantially perpendicular to the plurality of longitudinal lines. The plurality of transverse lines include at least a transverse centerline that intersects with the longitudinal centerline to define the origin at a geometric center of the mat.

Additionally, in one embodiment, the plurality of longitudinal lines further includes (i) a pair of fourth longitudinal lines that are equally spaced on either side of the longitudinal centerline, the pair of fourth longitudinal lines include a fifth identifier that is different than the first identifier, the second identifier, the third identifier and the fourth identifier; (ii) a pair of fifth longitudinal lines that are equally spaced on either side of the longitudinal centerline, the pair of fifth longitudinal lines include a sixth identifier that is different than the first identifier, the second identifier, the third identifier, the fourth identifier and the fifth identifier; and (iii) a pair of sixth longitudinal lines that are equally spaced on either side of the longitudinal centerline, the pair of sixth longitudinal lines include a seventh identifier that is different than the first identifier, the second identifier, the third identifier, the fourth identifier, the fifth identifier and the sixth identifier. In such embodiment, (i) the longitudinal centerline can be red, (ii) the pair of first longitudinal lines can be orange, (iii) the pair of second longitudinal lines can be yellow, (iv) the pair of third longitudinal lines can be green, (v) the pair of fourth longitudinal lines can be blue, (vi) the pair of fifth longitudinal lines can be indigo, and (vii) the pair of sixth longitudinal lines can be violet.

In certain embodiments, the origin is at a geometric center of the mat. In some such embodiments, the first indicia include a plurality of radial lines that extend outwardly away from the origin toward a perimeter of the mat. In one embodiment, the plurality of radial lines are spaced apart from one another by approximately fifteen degrees. Additionally, the mat can further comprise a pair of first symbols that are positioned on the first surface, the first symbols being positioned symmetrically relative to the origin, each of the first symbols being positioned along one of the radial lines.

In one embodiment, the second indicia include at least three concentric circles having a center that is positioned away from a geometric center of the mat. Additionally, the second indicia can include a discontinuous fourth concentric circle having a portion that extends substantially adjacent to a perimeter of the mat.

Additionally, in some embodiments, the second indicia include a plurality of first angular lines each having a first end positioned along the second axis and near a perimeter of the mat. The plurality of first angular lines can be spaced apart from one another by approximately fifteen degrees. Further, in one such embodiment, the mat is substantially rectangular having a first side and an opposed second side. In such embodiment, the plurality of first angular lines can each have a first end positioned along the second axis and near the perimeter of the mat along the first side. Moreover, the mat can further comprise a plurality of second angular lines each having a first end positioned along the second axis and near the perimeter of the mat along the second side.

In one embodiment, the second indicia include a pair of waves that extend along and are centered about the first axis. The pair of waves can be sinusoidal waves that intersect one another and are 180 degrees out of phase relative to one another. Further, in one embodiment, the intersection of the sinusoidal waves creates a plurality of ellipse-type shapes along the first axis, and each of the plurality of ellipse-type shapes can be a different color from each of the other ellipse-type shapes.

Additionally, in certain embodiments, the mat can include one or more materials selected from the group consisting of metals and minerals.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

The present invention is directed toward an exercise mat 10 that can be used as a measuring tool to help enhance the health and well-being of people. The mat 10 can have a variety of different uses. For example, the mat 10 can be used during exercise activities, including yoga, pilates, meditation, weight training, gymnastics, stretching, etc., as non-exclusive examples. Further, the mat 10 can be used as a training aid by an instructor to a student during any of the foregoing activities. Still further, the mat 10 can be used during medical procedures, chiropractic procedures, physical therapy, and/or during any other suitable activities. Additionally, the mat 10 can be used as a visual aid in any of the foregoing exercises or activities. The design of the mat 10 is useful for both a practitioner and/or an administrator for the purposes of promoting health and wellness through balance and harmony with visual aids and proprioception.

Figure 1A:
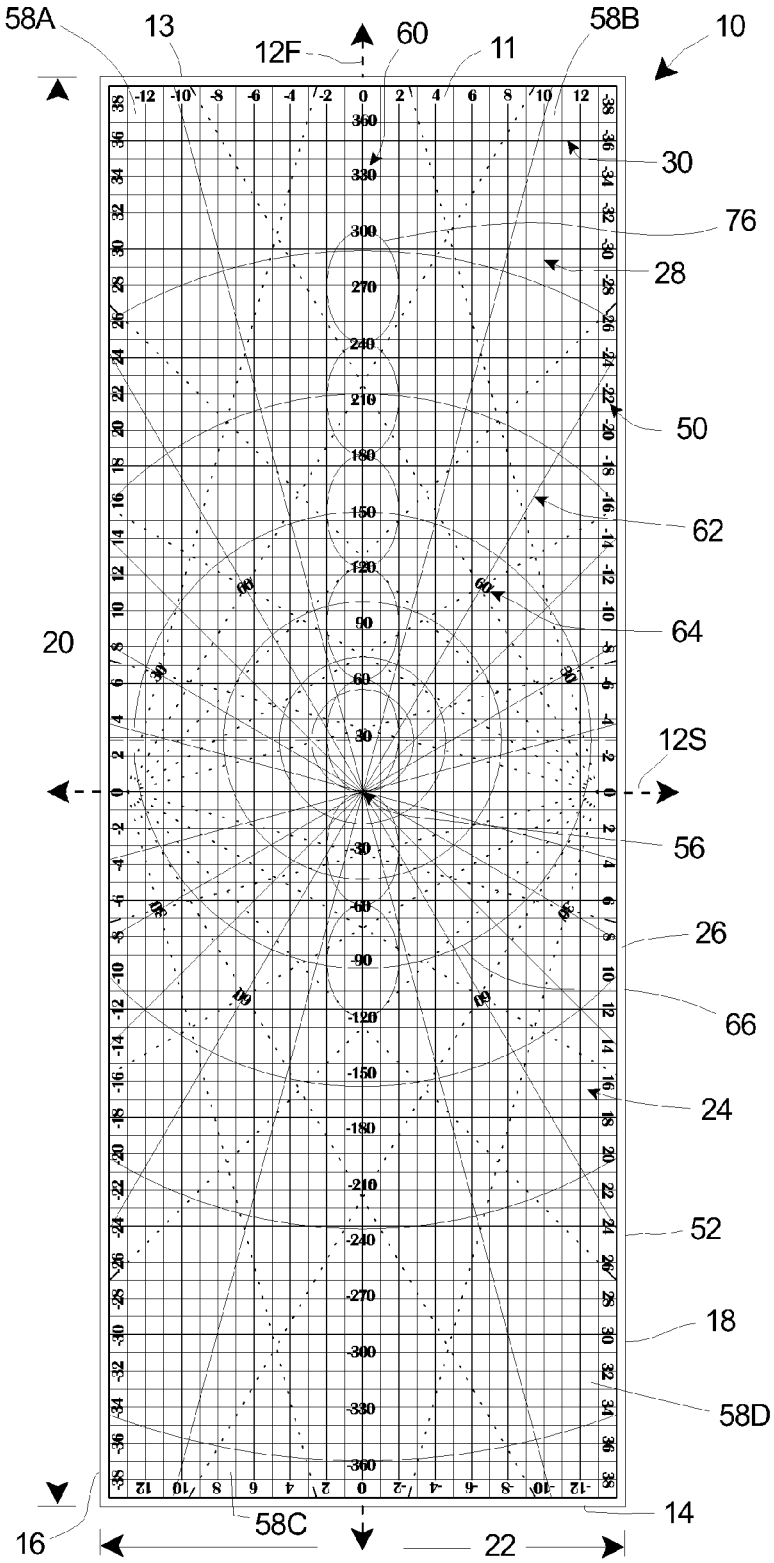
FIG. 1A is a top view of a mat having features of the present invention.
Figure 1B:
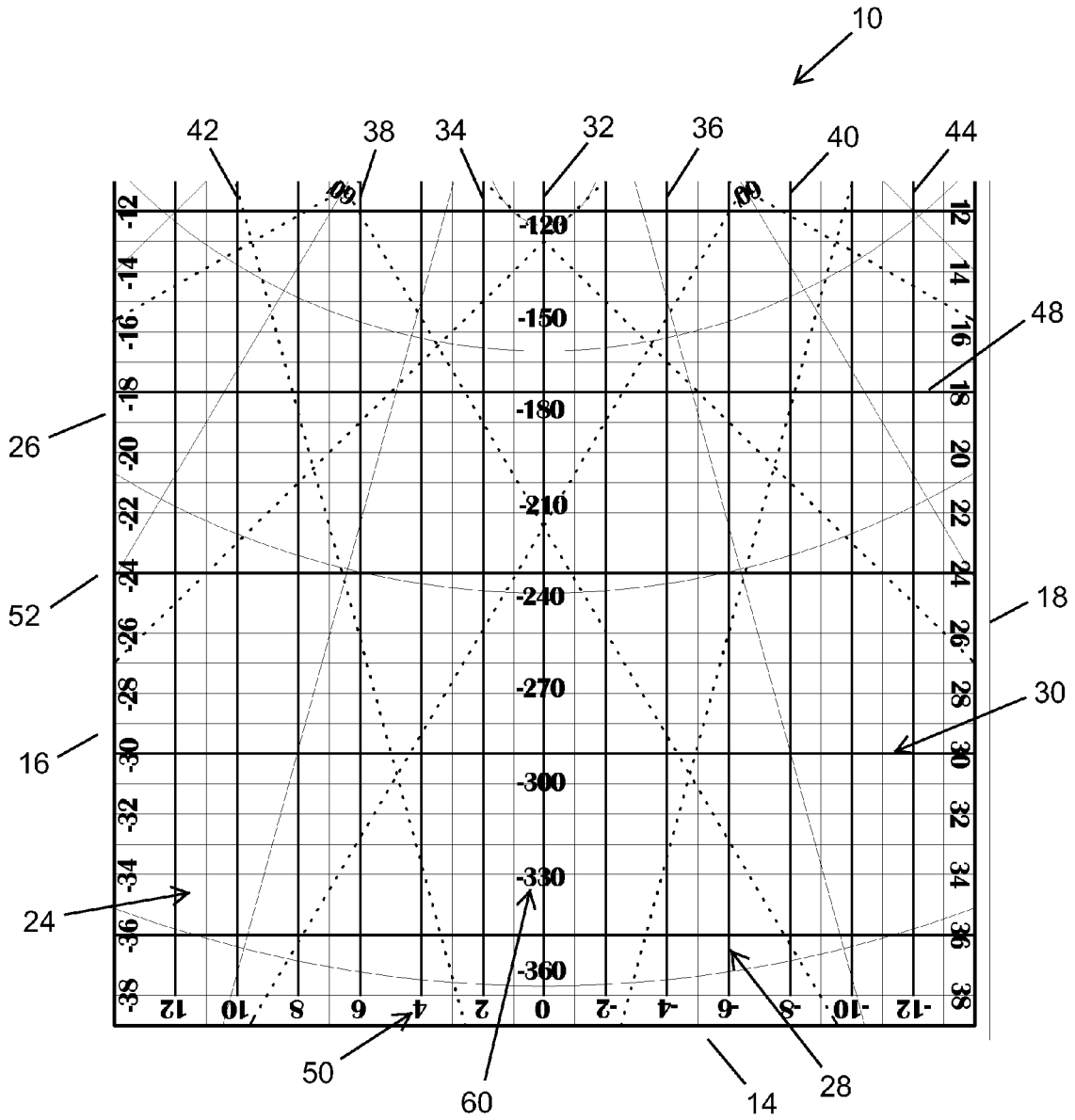
FIG. 1B is an enlarged top view of a portion of the mat illustrated in FIG. 1A.
Figure 1C:
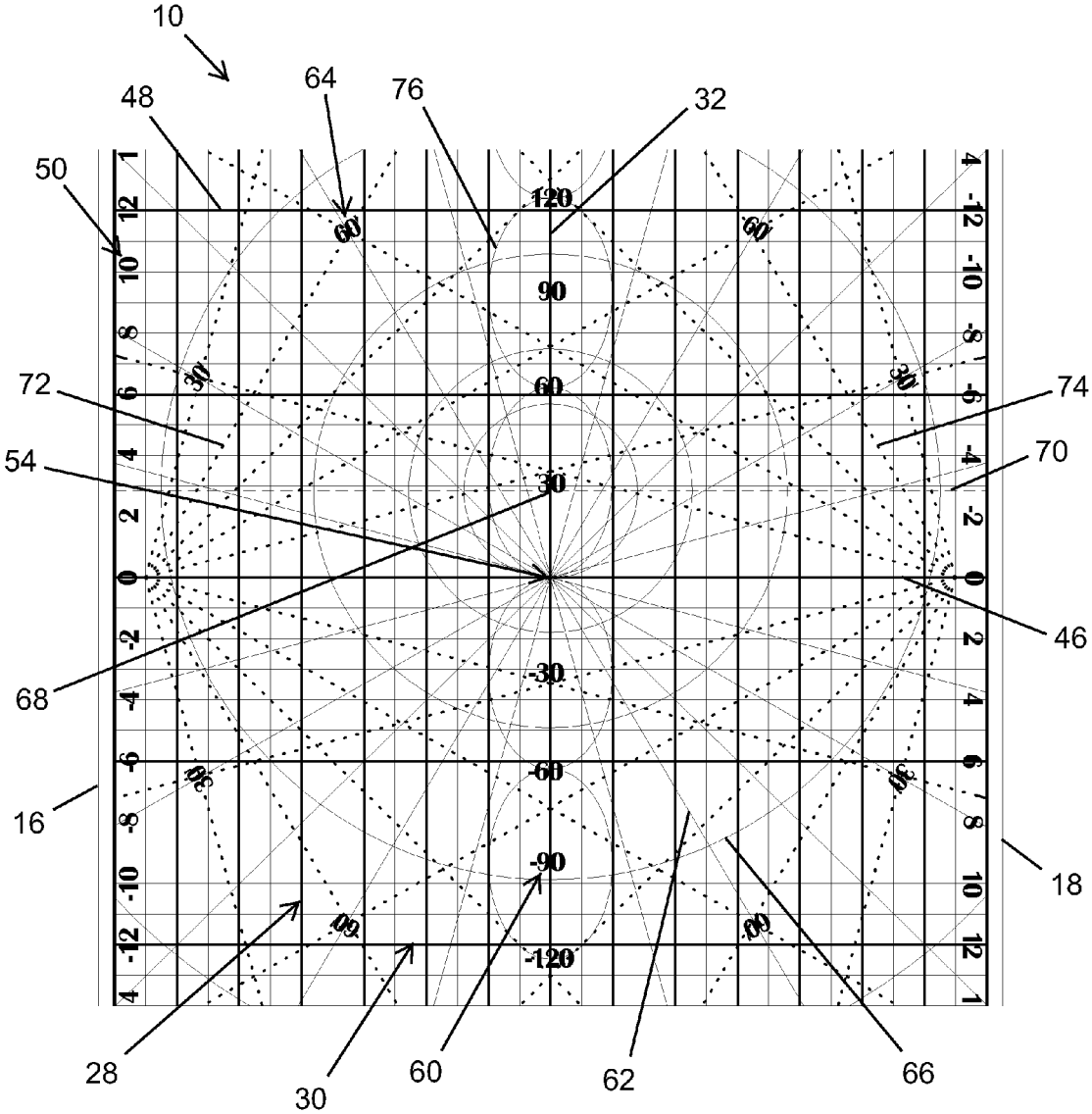
FIG. 1C is an enlarged top view of another portion of the mat illustrated in FIG. 1A.
Figure 1D:
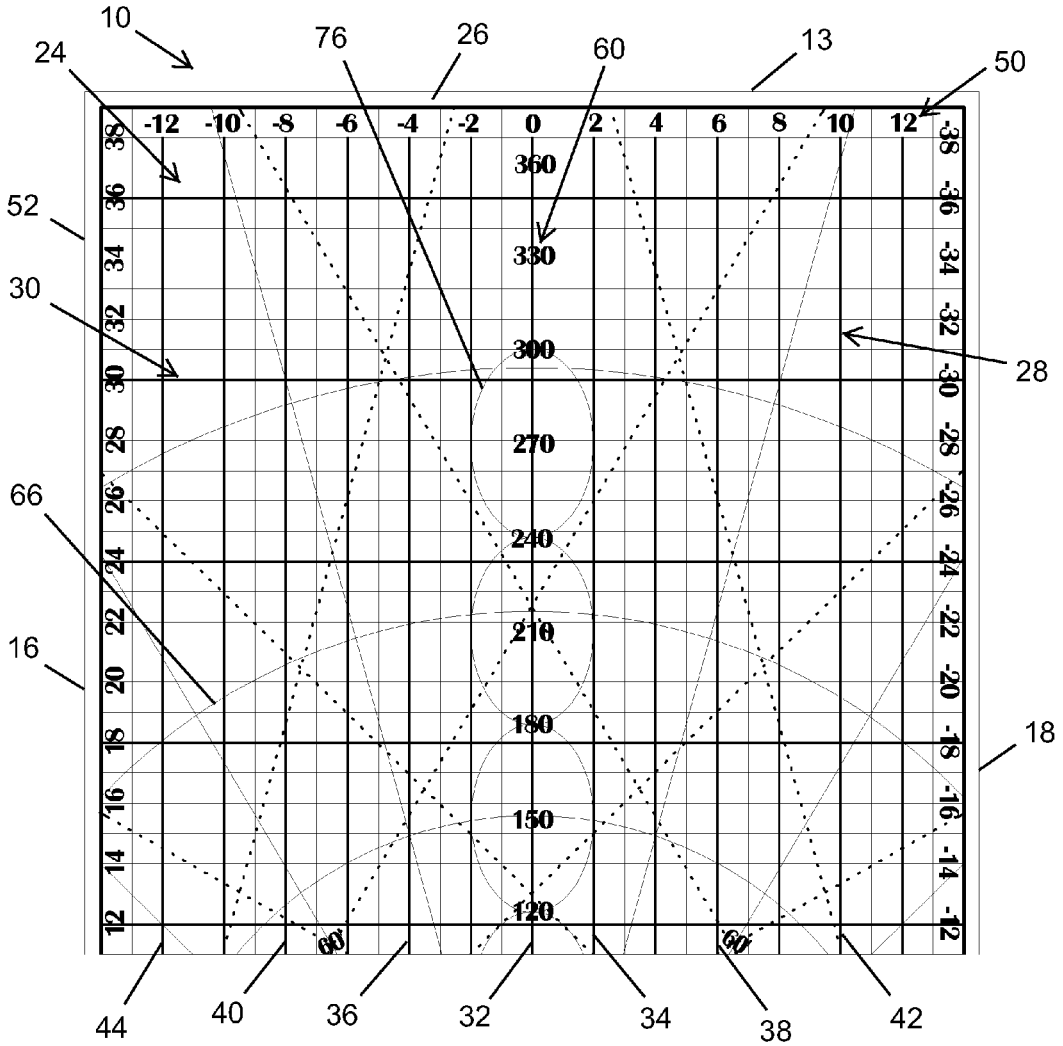
FIG. 1D is an enlarged top view of still another portion of the mat illustrated in FIG. 1A.

FIG. 1A is a top view of a mat 10 having features of the present invention. Additionally, FIGS. 1B-1D are enlarged top views of different portions of the mat of FIG. 1A. More particularly, each of FIGS. 1B-1D illustrates a different roughly one-third of the entire mat 10, with some overlap between the Figures to assist in providing a more complete picture of the mat 10. It should also be noted that certain features of the mat 10 are referenced on one or more of FIGS. 1B-1D instead of and/or in addition to being referenced on FIG. 1A in order to be able to more clearly illustrate the various features and elements of the present invention, and to not overly complicate the Figures and/or their descriptions.

In various embodiments, the mat 10 includes a first surface 11 and an opposed second surface (not illustrated). Additionally, as illustrated and described in detail herein, the first surface 11 of the mat 10 includes various lines, i.e. straight lines and/or curved lines, shapes, designs and/or symbols that are based on Pythagorean and sacred geometry. For example, in various embodiments, the first surface 11 of the mat 10 may include one or more circles, which relate to wholeness; one or more squares, which relate to foundation; one or more rectangles, which relate to production; and/or one or more triangles, which relate to preservation and immortality, as non-exclusive examples. Further, the first surface 11 of the mat 10 can include a plurality of symbols, e.g., alphanumeric symbols, which are positioned in a patterned display about the mat 10. Additionally and/or alternatively, the first surface 11 of the mat 10 can include more or fewer lines, shapes, designs and symbols than are specifically illustrated in FIG. 1A. As utilized herein, any of the lines, shapes, designs and/or symbols that are included on the mat 10 can be referred to herein individually and/or collectively as "indicia". It should be appreciated that the second surface of the mat 10 can also include various lines, shapes, designs and/or symbols that may be substantially similar to or different than the lines, shapes, designs and/or symbols included on the first surface 11.

Moreover, as described in detail herein, the mat 10 can be geometrically designed using the golden ratio and a Fibonacci sequence for accuracy in measuring distance and mass, while providing visually pleasing symmetry and tessellations that help reduce stress. For example, as provided herein, various lines, shapes, designs and/or symbols that are included on the mat 10 can be positioned in a symmetric manner relative to an origin that defines the geometric center of the mat 10. Additionally and/or alternatively, certain lines, shapes, designs and/or symbols can be positioned in a symmetric manner relative to an origin that is positioned away from the geometric center of the mat 10, e.g., such origin can be positioned on the mat 10 based on the "golden ratio" of approximately 1.618.

Further, the first surface 11 of the mat 10 can include a first axis 12F and a second axis 12S that is orthogonal to the first axis 12F. In some embodiments, the first axis 12F and/or the second axis 12S can substantially coincide with one or more of the lines that are included on the first surface 11 of the mat 10. Moreover, in certain embodiments, various lines, shapes, designs and/or symbols, i.e. various indicia, that are included on the mat 10 can be positioned symmetrically relative to one or both of the first axis 12F and the second axis 12S. Additionally and/or alternatively, various indicia that are included on the mat 10 can be positioned symmetrically relative to only one of the first axis 12F and the second axis 12S, while such indicia are positioned asymmetrically relative to the other of the first axis 12F and the second axis 12S.

It should be noted that although in the Figures certain lines are illustrated as being solid and certain lines are illustrated as being dotted or dashed lines, any of the lines on the mat 10 can be solid, dashed, dotted, etc. Additionally, the spaces between the dots and dashes can be varied, and/or the length or size of the dots and dashes can be varied without altering the intended breadth and scope of the present invention. Further, the different weights, thicknesses, darkness, colors, etc. of the lines, shapes, designs and/or symbols can also be varied from those specifically illustrated in the Figures.

As an overview, the mat 10 as illustrated and described herein can be utilized to provide and/or promote various concepts that can, in turn, be utilized to enhance the health and well-being of the person using the mat 10. For example, as a non-exclusive listing of such concepts, the mat 10 can be used: (A) as a visual reference guide to position the body toward correct postural alignment and symmetry; (B) as a visual reference guide for the purpose of measuring the body's range of motion; (C) as a tool to measure and/or verify the physical alignment or misalignment of the body; (D) as a tool to maximize the effectiveness of yoga postures; (E) as a tool or aid for use with physical therapy exercises (many physical therapy exercises and yoga exercises are substantially similar to one another); (F) as a tool or aid for chiropractic and/or naturopathic medicine (i.e. the chiropractor and/or patient can use the mat 10 to identify and measure physical alignment problems (the mat 10 can be used as a visual aid for both practitioner and patient) such that chiropractic adjustments can be done with more precision and accuracy); (G) as a tool or aid in the practice of orthopedics; (H) as a tool or aid for massage therapists or body workers (e.g., Reiki, acupuncturist, massage, shiatsu, Thai massage, reflexology, etc.); and/or (I) as a visual reference guide whether as part of the mat 10 or as a projected image that can be scaled to a distinct body size to locate the body's chakras.

Chakra is the Sanskrit word meaning "wheel of light". Additionally, chakras are circular, and when emerging from the body are vortices that are conical in shape. Further, chakras are centers of life force, or vital energy, and they correspond to vital points in the physical body i.e. major plexuses of arteries, veins and nerves. For example, in certain interpretations, the body includes seven chakras, namely: (1) First Chakra, i.e. the root chakra, relates to the spine and glandular system; and represents element Earth; (2) Second Chakra relates to the abdomen; and represents element water; (3) Third Chakra relates to the solar plexus, the adrenals, and the pancreas; and represents element fire; (4) Fourth Chakra relates to the heart and the thymus; and represents element air; (5) Fifth Chakra relates to the throat, the thyroid, and the parathyroid; and represents element ether; (6) Sixth Chakra relates to the forehead and the pituitary; and represents supreme element; and (7) Seventh Chakra relates to the top of the head and pineal; and represents beyond time and space.

The design of the mat 10 can be varied. As illustrated in FIG. 1A, the mat 10 can be substantially rectangle shaped having a first end 13, an opposed second end 14, a first side 16 and an opposed second side 18. Alternatively, the mat 10 can be other than rectangle shaped, i.e. the mat 10 can have any geometric shape, whether regular or irregular.

It should be understood that the use of the terms "first end", "second end", "first side" and "second side" are for convenience and ease of illustration, and either of the ends 13, 14 can be referred to as the "first end" or the "second end", and either of the sides 16, 18 can be referred to as the "first side" or the "second side". Additionally, any of the ends 13, 14 and/or sides 16, 18 of the mat 10 can also be referred to as "edges", such that any of the ends 13, 14 and/or sides 16, 18 can be referred to as a "first edge", a "second edge", a "third edge" and/or a "fourth edge", etc.

As shown in the embodiment illustrated in FIG. 1A, the mat 10 can have a length 20 that extends from the first end 13 to the second end 14, and a width 22 that extends from the first side 16 to the second side 18. In one non-exclusive embodiment, the mat 10 can have a length 20 of approximately 78.0 inches (198.13 centimeters) and a width 22 of approximately 28.0 inches (71.13 centimeters). Alternatively, the length 20 of the mat 10 can be greater than or less than approximately 78.0 inches and/or the width 22 of the mat 10 can be greater than or less than approximately 28.0 inches. Further, in alternative embodiments, the ratio of the length 20 to the width 22 can be at least approximately 2:1, 2.2:1, 2.4:1, 2.6:1, 2.8:1, 3.0:1, 3.2:1, 3.4:1, 3.6:1, 3.8:1, 4.0:1, or another suitable ratio.

Additionally, as described in detail herein, the mat 10 can include a variety of geometric shapes, lines, symbols, vectors and ratios to accurately calculate body dimensions for different size individuals.

In one embodiment, the mat 10 can be comprised of a plurality of squares 24, e.g., one-inch squares, that cover some of, most of, substantially all of, or the entire mat 10. Additionally, the squares 24 can be positioned such that each square 24 is substantially adjacent to at least two other squares 24. Further, as shown, the squares 24 can be oriented such that each of the sides of the squares 24 is parallel to or perpendicular to the ends 13, 14 and the sides 16, 18 of the mat. For example, in one non-exclusive alternative embodiment, when the mat 10 is rectangle shaped having a length 20 of approximately 78.0 inches and a width 22 of approximately 28.0 inches, and when the mat 10 includes a plurality of one-inch squares 24 that cover at least substantially the entire surface of the mat 10, the mat 10 can include 2,184 such squares 24. Alternatively, the mat 10 can have a different length 20, a different width 22, the plurality of squares 24 can be of a different size and/or orientation, the squares 24 can cover less than substantially the entire surface of the mat 10, and/or the mat 10 can include greater than or less than 2,184 squares 24. Additionally and/or alternatively, in certain embodiments, the mat 10 can further include a border 26 that surrounds the plurality of squares 16.

Further, as shown in FIG. 1A, the mat 10 can include a plurality of longitudinal lines 28 that are spaced apart from and substantially parallel to one another, and that extend substantially from the first end 13 to the second end 14 of the mat 10. Additionally, the mat 10 can also include a plurality of transverse (or lateral) lines 30 that are spaced apart from and substantially parallel to one another, and that extend substantially from the first side 16 to the second side 18 of the mat 10. Further, as illustrated, the transverse lines 30 can be substantially perpendicular to the longitudinal lines 28. In different embodiments, the number, style, color, positioning and spacing of the longitudinal lines 28 and the transverse lines 30 can be varied. It should be noted that the longitudinal lines 28 and the transverse lines 30 are considered separately from the plurality of squares 24, although the lines used for each may overlap and/or coincide with one another. Additionally, it should be appreciated that in certain embodiments, the longitudinal lines 28 and/or the transverse lines 30 can be thicker, darker and/or of different color that the individual lines that are used to form the plurality of squares 24, i.e. that do not otherwise overlap or coincide with the longitudinal lines 28 and/or the transverse lines 30.

In certain non-exclusive alternative embodiments, as illustrated in FIG. 1A, the mat 10 can include thirteen longitudinal lines 28. More particularly, as illustrated, the mat 10 can include: (i) a longitudinal centerline 32 that is substantially centrally positioned relative to the first side 16 and the second side 18; (ii) a pair of first longitudinal lines 34 that are spaced apart an equal distance, e.g., approximately two inches, from the longitudinal centerline 32 on either side of the longitudinal centerline 32; (iii) a pair of second longitudinal lines 36 that are spaced apart a further equal distance, e.g., approximately four inches, from the longitudinal centerline 32 on either side of the longitudinal centerline 32; (iv) a pair of third longitudinal lines 38 that are spaced apart still a further equal distance, e.g., approximately six inches, from the longitudinal centerline 32 on either side of the longitudinal centerline 32; (v) a pair of fourth longitudinal lines 40 that are spaced apart yet a further equal distance, e.g., approximately eight inches, from the longitudinal centerline 32 on either side of the longitudinal centerline 32; (vi) a pair of fifth longitudinal lines 42 that are spaced apart still a further equal distance, e.g., approximately ten inches, from the longitudinal centerline 32 on either side of the longitudinal centerline 32; and (vii) a pair of sixth longitudinal lines 44 that are spaced apart still yet a further equal distance, e.g., approximately twelve inches, from the longitudinal centerline 32 on either side of the longitudinal centerline 32.

As noted above, it should be appreciated that the longitudinal lines 28 can also be referred to individually and/or collectively as indicia, and/or the pairs of longitudinal lines 34, 36, 38, 40, 42, 44 can also be referred to as pairs of indicia. Additionally, it should be understood that the use of the terms "first longitudinal lines", "second longitudinal lines", "third longitudinal lines", "fourth longitudinal lines", "fifth longitudinal lines" and "sixth longitudinal lines" is merely for purposes of clarity and ease of description, and any of the pairs of longitudinal lines can be referred to as first, second, third, fourth, fifth or sixth pairs of longitudinal lines (or pairs of indicia).

As illustrated, the longitudinal lines 28 can be substantially equally spaced apart from one another, e.g., approximately two inches apart from adjacent longitudinal lines, substantially from the first side 16 to the second side 18 of the mat 10. Alternatively, the longitudinal lines 28 can have unequal spacing from one another and/or the longitudinal lines 28 need not be positioned substantially from the first side 16 to the second side 18.

Additionally, the color, darkness and/or thickness of the longitudinal lines 28 can be varied, including relative to one another. Moreover, any differences in color, darkness and/or thickness between the longitudinal lines 28 can be utilized as "identifiers" for the practitioner and/or the administrator to distinguish between the different longitudinal lines 28. For example, in one such non-exclusive alternative embodiment, (i) the longitudinal centerline 32 can be red (e.g., representing the root chakra; yang, warm, and stimulating; and producing heat); (ii) the first longitudinal lines 34 can be orange (e.g., representing gentle yang; tonifies) and can be spaced apart approximately two inches from the longitudinal centerline 32; (iii) the second longitudinal lines 36 can be yellow (e.g., representing yang; strengthens motor system and metabolism) and can be spaced apart approximately four inches from the longitudinal centerline 32; (iv) the third longitudinal lines 38 can be green (e.g., representing neutral yin; slightly cooling) and can be spaced apart approximately six inches from the longitudinal centerline 32; (v) the fourth longitudinal lines 40 can be blue (e.g., representing yin; cool) and can be spaced apart approximately eight inches from the longitudinal centerline 32; (vi) the fifth longitudinal lines 42 can be indigo and can be spaced apart approximately ten inches from the longitudinal centerline 32; and (vii) the sixth longitudinal lines 44 can be violet (e.g., the most yin color) and can be spaced apart approximately twelve inches from the longitudinal centerline 32. Alternatively, the color and/or spacing of the longitudinal lines 28 can be different than specifically described herein above.

Further, in one embodiment, the longitudinal centerline 32 can substantially coincide with the first axis 12F. Alternatively, other of the longitudinal lines 28 can substantially coincide with the first axis 12F. Still alternatively, the first axis 12F can be provided and/or oriented such that none of the longitudinal lines 28 substantially coincide with the first axis 12F.

In certain non-exclusive alternative embodiments, as illustrated in FIG. 1A, the mat 10 can include thirteen transverse lines 30. More particularly, as illustrated, the mat 10 can include: (i) a transverse centerline 46 that is substantially centrally positioned relative to the first end 13 and the second side 14; and (ii) a plurality of non-central transverse lines 48 (i.e. twelve in this particular embodiment) that are spaced apart an equal distance from one another (and/or from the transverse centerline 46 itself) in either direction away from the transverse centerline 46. In one such embodiment, the transverse centerline 46 can be red; and the non-central transverse lines 48 can be relatively thick, grey lines that are spaced apart approximately six inches from one another (and/or from the transverse centerline 46 itself) in either direction away from the transverse centerline 46. Alternatively, the color and/or spacing of the transverse lines 30 can be different than specifically described herein above.

Moreover, in one embodiment, the transverse centerline 46 can substantially coincide with the second axis 12S. Alternatively, other of the transverse lines 30 can substantially coincide with the second axis 12S. Still alternatively, the second axis 12S can be provided and/or oriented such that none of the transverse lines 30 substantially coincide with the second axis 12S.

As noted above, it should be appreciated that the transverse lines 30, i.e. the transverse centerline 46 and/or the non-central transverse lines 48, can also be referred to individually and/or collectively as indicia.

As illustrated, the mat 10 can further include a plurality of first symbols 50 (also referred to herein as "first symbolic indicia" or simply "indicia"), e.g., alphanumeric symbols, that are positioned at or near a perimeter 52 of the mat 10. For example, in one non-exclusive alternative embodiment, the first symbolic indicia 50 can include (i) the number "0" on either end of the longitudinal centerline 32; (ii) the numbers "2", "4", "6", "8", "10" and "13" equally spaced apart as one moves away (from left-to-right at the first end 13 and from right-to-left at the second end 14 as illustrated in FIG. 1A) from the longitudinal centerline 32, e.g., to coincide with the ends of certain of the plurality of longitudinal lines 28; (iii) the numbers "−2", "−4", "−6", "−8", "−10" and "−13" equally spaced apart as one moves away (from right-to-left at the first end 13 and from left-to-right at the second end 14 as illustrated in FIG. 1A) from the longitudinal centerline 32, e.g., to coincide with the ends of certain of the plurality of longitudinal lines 28; (iv) the number "0" on either end of the transverse centerline 46; (v) the numbers "2", "4", "6", "8", "10", "13", "14", "16", "18", "20", "22", "24", "26", "28", "30", "32", "34" and "36" equally spaced apart as one moves away (from middle-to-top along the first side 16 and from middle-to-bottom along the second side 18 as illustrated in FIG. 1A) from the transverse centerline 46; and (vi) the numbers "−2", "−4", "−6", "−8", "−10", "−13", "−14", "−16", "−18", "−20", "−22", "−24", "−26", "−28", "−30", "−32", "−34" and "−36" equally spaced apart as one moves away (from middle-to-bottom along the first side 16 and from middle-to-top along the second side 18 as illustrated in FIG. 1A) from the transverse centerline 46. Alternatively, the first symbols 50 can include different symbols, and/or the positioning and spacing of the first symbols 50 can be different than specifically illustrated in FIG. 1A. For example, the first symbols 50 can be positioned away from the perimeter 52 of the mat 10.

As shown in FIG. 1A, it should be appreciated that the positioning of the first symbols 50 at or near the ends of the longitudinal lines 28 and/or the transverse lines 30 enables such first symbols 50 to also be utilized as "identifiers" for the practitioner and/or the administrator to distinguish between the longitudinal lines 28 and/or the transverse lines 30.

It should be noted that the intersection of one or more of the lines along the mat 10 can define and/or establish an origin 54 for purposes are defining and/or explaining the positioning of various other indicia on the mat 10. For example, the intersection of the longitudinal centerline 32 and the transverse centerline 46 can define an origin 54 that is positioned at a geometric center 56 of the mat 10. Moreover, the intersection of the longitudinal centerline 32 and the transverse centerline 46 define a first quadrant 58A, a second quadrant 58B, a third quadrant 58C and a fourth quadrant 58D along the first surface 11 of the mat 10. In such application, it should be appreciated that in the specific embodiment illustrated in the Figures, the geometric center 56 of the mat 10 is effectively labeled with the first symbols 50 as the [0, 0] point. Alternatively, in some embodiments, other lines can intersect with one another to define an origin 54 that is positioned at or spaced apart from the geometric center of the mat 10.

Further, it should also be appreciated that, in the specific embodiment illustrated in FIG. 1A, when the origin 54 is defined as the geometric center 56 of the mat 10, e.g., based on the intersection of the longitudinal centerline 32 and the transverse centerline 46, (i) the first longitudinal lines 34 are positioned symmetrically relative to the origin 54, (ii) the second longitudinal lines 36 are positioned symmetrically relative to the origin 54, (iii) the third longitudinal lines 38 are positioned symmetrically relative to the origin 54, (iv) the fourth longitudinal lines 40 are positioned symmetrically relative to the origin 54, (v) the fifth longitudinal lines 42 are positioned symmetrically relative to the origin 54, (vi) the sixth longitudinal lines 44 are positioned symmetrically relative to the origin 54, (vii) various pairs of non-central transverse lines 48 are positioned symmetrically relative to the origin 54, and (viii) various pairs or groups of first symbols 50 are positioned symmetrically relative to the origin 54.

Additionally, in one embodiment, when the longitudinal centerline 32 substantially coincides with the first axis 12F and the transverse centerline 46 substantially coincides with the second axis 12S, (i) the first longitudinal lines 34 can be positioned symmetrically relative to the longitudinal centerline 32 and/or the first axis 12F, (ii) the second longitudinal lines 36 can be positioned symmetrically relative to the longitudinal centerline 32 and/or the first axis 12F, (iii) the third longitudinal lines 38 can be positioned symmetrically relative to the longitudinal centerline 32 and/or the first axis 12F, (iv) the fourth longitudinal lines 40 can be positioned symmetrically relative to the longitudinal centerline 32 and/or the first axis 12F, (v) the fifth longitudinal lines 42 can be positioned symmetrically relative to the longitudinal centerline 32 and/or the first axis 12F, (vi) the sixth longitudinal lines 44 can be positioned symmetrically relative to the longitudinal centerline 32 and/or the first axis 12F, and (vii) various pairs of non-central transverse lines 48 can be positioned symmetrically relative to the transverse centerline 46 and/or the second axis 12S.

Still further, it should be appreciated that, in the specific embodiment illustrated in FIG. 1A, when the origin 54 is defined as the geometric center 56 of the mat 10, e.g., based on the intersection of the longitudinal centerline 32 and the transverse centerline 46, various pairs or groups of first symbols 50, i.e. first symbols 50 that match one another, are positioned symmetrically relative to the origin 54. Moreover, it should also be appreciated that such pairs or groups of first symbols 50, i.e. first symbols that match one another, are not positioned symmetrically relative to the longitudinal centerline 32 and/or the transverse centerline 46.

Additionally, as illustrated, the mat 10 can further include a plurality of second symbols 60 (also referred to herein as "second symbolic indicia" or simply "indicia"), e.g., alphanumeric symbols, that are positioned substantially along the longitudinal centerline 32. For example, in one non-exclusive alternative embodiment, the second symbolic indicia 60 can include (i) the numbers "30", "60", "90", "130", "150", "180", "210", "240", "270", "300", "330" and "360" equally spaced apart as one moves away from the transverse centerline 46 and along (from middle-to-top in FIG. 1A) the longitudinal centerline 32; and (ii) the numbers "−30", "−60", "−90", "−130", "−150", "−180", "−210", "−240", "−270", "−300", "−330" and "−360" equally spaced apart as one moves away from the transverse centerline 46 and along (from middle-to-bottom in FIG. 1A) the longitudinal centerline 32. Alternatively, the second symbols 60 can include different symbols, and/or the positioning and spacing of the second symbols 60 can be different than specifically illustrated in FIG. 1A. For example, the second symbols 60 can be positioned away from the longitudinal centerline 32.

It should be further appreciated that, in the specific embodiment illustrated in FIG. 1A, when the origin 54 is defined as the geometric center 56 of the mat 10, e.g., based on the intersection of the longitudinal centerline 32 and the transverse centerline 46, various pairs or groups of second symbols 60 are positioned symmetrically relative to the origin 54.

FIG. 1A further illustrates that the mat 10 can also include a plurality of radial lines 62 that extend outwardly from the intersection of the longitudinal centerline 32 and the transverse centerline 46, i.e. from the geometric center 56 of the mat 10, toward the perimeter 52 of the mat 10. For example, in one non-exclusive alternative embodiment, the radial lines 62 can be spaced apart from one another by approximately fifteen degrees. Stated in another manner, some of the plurality of radial lines 62 extend outwardly away from the geometric center 56 of the mat 10 in each of the quadrants 58A, 58B, 58C, 58D of the mat 10. Additionally, certain of the radial lines 62 effectively coincide with the longitudinal centerline 32 and the transverse centerline 46. Alternatively, the radial lines 62 can be spaced apart by more than fifteen degrees or less than fifteen degrees as the radial lines 62 extend away from the geometric center 56 of the mat 10. Still alternatively, the radial lines 62 can extend away from a point other than the geometric center 56 of the mat 10.

Further, as illustrated, the mat 10 can also include a plurality of third symbols 64 (also referred to herein as "third symbolic indicia" or simply "indicia"), e.g., alphanumeric symbols, that are positioned along certain of the radial lines 62. For example, in one non-exclusive alternative embodiment, the third symbolic indicia 64 can include the numbers "30'" and "60'" that are positioned along the radial lines 62 that are thirty degrees and sixty degrees from the transverse centerline 46. Stated in another manner, in such embodiment, each of the radial lines 62 that is approximately thirty degrees away from the transverse centerline 46, i.e. in all four planar directions and/or in each quadrant 58A, 58B, 58C, 58D, can be labeled with the third symbol 64 of "30'", and each of the radial lines 62 that is approximately sixty degrees away from the transverse centerline 46, i.e. in all four planar directions and/or in each quadrant 58A, 58B, 58C, 58D, can be labeled with the third symbol 64 of "60'". Alternatively, the third symbols 64 can include different symbols, and/or the positioning and spacing of the third symbols 64 can be different than specifically illustrated in FIG. 1A. For example, the third symbols 64 can be positioned away from the radial lines 62.

It should be noted that the use of the terms "first symbols", "second symbols" and "third symbols" is merely for convenience of illustration and ease of description, and any of the symbols can be referred to as the "first symbols", "second symbols" and/or "third symbols".

Additionally, it should be further appreciated that, in the specific embodiment illustrated in FIG. 1A, when the origin 54 is defined as the geometric center 56 of the mat 10, e.g., based on the intersection of the longitudinal centerline 32 and the transverse centerline 46, (i) various pairs of radial lines 62 are positioned symmetrically relative to the origin 54, and (ii) various pairs or groups of third symbols 64 are positioned symmetrically relative to the origin 54. Moreover, it should also be appreciated that in the embodiment illustrated in the Figures, (i) various pairs of radial lines 62 are positioned symmetrically relative to the longitudinal centerline 32, (ii) various pairs of radial lines 62 are positioned symmetrically relative to the transverse centerline 46, (iii) various pairs or groups of third symbols 64 are positioned symmetrically relative to the longitudinal centerline 32, and (iv) various pairs or groups of third symbols 64 are positioned symmetrically relative to the transverse centerline 46.

In some embodiments, the mat 10 can further include a plurality of circles 66. The circles 66 are included to represent harmony and balance in the human body. It should be noted that the plurality of circles 66 is intended to include portions of circles that are not fully completed on the mat 10 because they extend beyond the width 22 of the mat 10. Stated in another manner, some of the plurality of circles 66 are discontinuous as such circles 66 have a portion that extends adjacent to the perimeter 52 of the mat 10.

In certain such embodiments, the plurality of circles 66 can be concentric circles. Additionally, in certain embodiments, the circles 66 can have a center 68 that is at an origin 54 that is positioned away from the geometric center 56 of the mat 10. For example, as shown in FIG. 1A, the center 68 of the circles 66 can be at a point (i.e. an origin 54) along the longitudinal centerline 32, but spaced apart from the transverse centerline 46. In certain non-exclusive alternative embodiments, the center 68 of the circles 66 can be approximately 2.5, 2.55, 2.60, 2.65, 2.70, 2.75, 2.80, 2.85, 2.90, 2.95, 3.00, 3.05, 3.10, 3.15, 3.20, 3.25, 3.30, 3.35, 3.40, 3.45 or 3.50 inches, or some other distance, from the transverse centerline 46. Alternatively, the center 68 of the circles 66 can be at a different point, e.g., away from the longitudinal centerline 32.

Moreover, the mat 10 can further include a centering line 70 that extends substantially parallel to the transverse centerline 46 and helps to define the center 68 of the circles 66 as the centering line 70 intersects with the longitudinal centerline 32. The centering line 70 can have any suitable design. In one non-exclusive embodiment, the centering line 70 can be red and be partially broken or dashed.

The number, size and spacing of the circles 66 (or portions thereof) can be varied. In one embodiment, the mat 10 can include seven circles 66 that get progressively further apart from one another as the circles 66 are positioned farther away from the center 68 of the circles 66. More particularly, in such embodiment, the mat 10 can include four complete circles 66 and three discontinuous circles 66. For example, concentric circles 66 or rings spaced by the golden ratio converge inward toward the center of the body. These circles 66 or rings represent the calmest and most stable locations in a circular standing wave. Alternatively, the mat 10 can include greater than seven or less than seven circles 66, and/or the size and spacing of the circles 66 can be different than specifically shown in the Figures.

Further, as illustrated in this embodiment, the circles 66 can be positioned symmetrically relative to the longitudinal centerline 32, and the circles 66 can be positioned asymmetrically relative to the transverse centerline 46 and the geometric center 56 of the mat 10.

Additionally, in some embodiments, the mat 10 can include a plurality of first angular lines 72 and a plurality of second angular lines 74. As illustrated, the first angular lines 72 can be dotted lines that emanate from a common starting point or origin 54, e.g., along the transverse centerline 46 and near the perimeter 52 along the first side 16 of the mat 10. Stated in another manner, each of the first angular lines 72 includes an end that is positioned along the transverse centerline 46 and/or the second axis 12S near the perimeter 52 of the mat 10 along the first side 16. Further, the first angular lines 72 can be spaced apart from one another such that they are directed approximately every fifteen degrees relative to one another. Somewhat similarly, the second angular lines 74 can also be dotted lines that emanate from a common starting point or origin 54, e.g., along the transverse centerline 46 and near the perimeter 52 along the second side 18 of the mat 10. Stated in another manner, each of the second angular lines 74 includes an end that is positioned along the transverse centerline 46 and/or the second axis 12S near the perimeter 52 of the mat 10 along the second side 18. Further, the second angular lines 74 can be spaced apart from one another such that they are directed approximately every fifteen degrees relative to one another. Alternatively, the style, the starting point, the number, and the direction of the first angular lines 72 and/or the second angular lines 74 can be different than as specifically illustrated in the Figures.

It should be appreciated that, in the specific embodiment illustrated in FIG. 1A, when the origin 54 is defined as the geometric center 56 of the mat 10, e.g., based on the intersection of the longitudinal centerline 32 and the transverse centerline 46, individual first angular lines 72 can be paired with individual second angular lines 74 such that the paired lines are positioned symmetrically relative to the origin 54. Additionally, it should further be appreciated that various pairs of first angular lines 72 and/or various pairs of second angular lines 74 are shown as being positioned symmetrically relative to an origin 54 that is spaced away from the geometric center 56 of the mat 10, i.e. at the common starting point for the first angular lines 72 or at the common starting point for the second angular lines 74, respectively. Further, it should also be appreciated that various pairs of first angular lines 72 and/or various pairs of second angular lines 74 are positioned symmetrically relative to the longitudinal centerline 32 and/or the transverse centerline 46.

Further, as shown in the Figures, the mat 10 can further include a pair of waves 76, e.g., sinusoidal waves. The design, size, amplitude, wavelength, positioning, and coloring of the waves 76 can be varied. As illustrated, the pair of waves 76 can be positioned to intersect one another. Additionally, in some embodiments, the waves 76 can be approximately 180 degrees out of phase relative to one another such that the waves 76 effectively create a plurality of similar-sized ellipse-type shapes. Further, in one non-exclusive embodiment, the waves 76 can extend along and be centered about the longitudinal centerline 32 and/or the first axis 12F, such that the ellipse-type shapes are also centered about the longitudinal centerline 32 and/or the first axis 12F. Stated in another manner, the waves 76 can be positioned symmetrically relative to the longitudinal centerline 32 and/or the first axis 12F.

Still further, in the embodiment illustrated in FIG. 1A, the waves 76 can extend such distance that they cooperate to form seven ellipse-type shapes. Additionally, the waves 76 can be positioned such that the waves 76 extend closer to the first end 13 than the second end 14 of the mat 10. For example, the waves 76 can extend from approximately from the "300" position to the "−110" position along the longitudinal centerline 32, and the waves 76 can extend approximately two inches on either side of the longitudinal centerline 32. The use of the longitudinal centerline 32 can equate to the spine, which represents an axis of resonance in the body partitioned into 24 discrete harmonic frequencies. Further, the position of the middle ellipse-type shape, i.e. the fourth of the seven ellipse-type shapes, can be such that the longitudinal center of the middle ellipse-type shape is located based on the "golden ratio". Stated in another manner, the middle ellipse-type shape can be centered at a point that is approximately 1/1.618 of the way from the second end 14 of the mat 10 to the first end 13 of the mat 10. Still further, the point of maximum resonance (a 5:3 ratio) aligns precisely with the lower throat and top of the heart. The point of maximum damping (the golden ratio) then aligns with the lower heart. Moreover, in one embodiment, the waves 76 can include a color pattern such that the waves 76 are colored consecutively from near the first end 13 and toward the second end 14 as violet, indigo, blue, green, yellow, orange and red.

The mat 10 can be formed from and/or can include any suitable materials such as polyvinyl chloride, thermoplastic elastomer, rubber, rubber-like material, ethylene vinyl acetate, polymer environmental-friendly resin, cotton, microfiber, polyester, wool or a moisture absorbent fabric. Since exercises are often practiced with bare feet in positions demanding body balances, the surface of the mat 10 can be non-slip and can include patterns, such as projections and/or indentations, to inhibit slipping. In certain embodiments, the mat 10 can be made from and/or can include one or more metals and/or minerals. For example, in certain non-exclusive alternative embodiments, the mat 10 can be made from and/or can include magnets, ceramics, silver, gold, jade, crystals, smoky quartz, bloodstone, fire agate, hematite, citrine, carnelian, moonstone, golden topaz, rutilated quartz, sunstone, calcite, malachite, rose quartz, watermelon tourine, turquoise, sodalite, lapis lazuli, celestite, aquamarine, purple fluorite, azurite, and amethyst. Additionally and/or alternatively, the mat 10 can be made from and/or can include other suitable materials.

Further, the mat 10 can have a thickness of at least approximately 0.1 inches, up to approximately 1.0 inches, although the mat 10 can function equally as well outside of the foregoing thickness range.

As illustrated and described herein, the various geometric configurations that are included on the mat 10 are interrelated with one another. Additionally, each color has its polar meridian or exact opposite angles in polar notation are expressed in degrees or radians ($2\pi$ radians being equal to 360°). Further, the intersections and/or interrelationships of the various geometric configurations are accurate in predicting each of the key plexus points. Moreover, the color bands, as described herein, correlate with the chakras, and the seven basic layers of the auric field. These graduate from the body, lined with each of the seven basic chakras.

Additionally, as illustrated and described, the mat 10 can comprise certain additional features and/or can realize certain additional benefits. For example, the mat 10 can include intertwining sound frequencies and geometry; can be used for locating energy meridians; can include geometric configurations that are visually in harmony, interrelated, and help reduce stress; can comprise damping wells that follow Fibonacci proportions in magnetic standing waves; and/or can include Fibonacci vortices at golden sections in standing waves that distribute energy and enable harmonic formation.

Further, the radius of the circle, e.g., $2\pi$, is aligned with one full cycle of a harmonic standing wave with the navel, the fifth harmonic (a 3:2 proportion) can be found to match the curvature of the human spine. The location and spacing of the seven tones of a musical major scale align with the seven Hindu chakra locations in the body. Chakra colors align to these locations when the perineum (at the bottom of the torso) is assigned at the bottom of the visible light spectrum.

While a number of exemplary aspects and embodiments of an exercise mat 10 have been shown and disclosed herein above, those of skill in the art will recognize certain modifications, permutations, additions and sub-combinations thereof. It is therefore intended that the mat 10 shall be interpreted to include all such modifications, permutations, additions and sub-combinations as are within their true spirit and scope, and no limitations are intended to the details of construction or design herein shown.

What is claimed is:

1. A mat including a first surface, the first surface having a first axis and a second axis that is orthogonal to the first axis, the mat comprising:

an origin that is positioned along one of the axes;

a first indicia that is positioned on the first surface, the first indicia being positioned symmetrically relative to the origin; and a second indicia that is positioned on the first surface, the second indicia being positioned symmetrically relative to only one of the axes, the second indicia including at least three concentric circles.

2. The mat of claim 1 wherein the first indicia include a plurality of longitudinal lines that extend substantially parallel to one another, the plurality of longitudinal lines including at least (i) a longitudinal centerline, (ii) a pair of first longitudinal lines that are equally spaced on either side of the longitudinal centerline, (iii) a pair of second longitudinal lines that are equally spaced on either side of the longitudinal centerline, and (iv) a pair of third longitudinal lines that are equally spaced on either side of the longitudinal centerline.

3. The mat of claim 2 wherein the longitudinal centerline includes a first identifier, and the pair of first longitudinal lines include a second identifier that is different than the first identifier.

4. The mat of claim 2 further comprising a plurality of transverse lines that are substantially equally spaced apart from and substantially parallel to one another, the plurality of transverse lines being substantially perpendicular to the plurality of longitudinal lines, the plurality of transverse lines including at least a transverse centerline that intersects with the longitudinal centerline to define the origin at a geometric center of the mat.

5. The mat of claim 1 wherein the origin is at a geometric center of the mat, and wherein the first indicia include a plurality of radial lines that extend outwardly away from the origin toward a perimeter of the mat.

6. The mat of claim 5 further comprising a pair of first symbols that are positioned on the first surface, the first symbols being positioned symmetrically relative to the origin, each of the first symbols being positioned along one of the radial lines.

7. The mat of claim 1 wherein the concentric circles have a center that is positioned away from a geometric center of the mat.

8. The mat of claim 1 wherein the second indicia includes a discontinuous fourth concentric circle having a portion that extends adjacent to a perimeter of the mat.

9. The mat of claim 1 further comprising a third indicia that is positioned on the first surface, the third indicia being positioned symmetrically relative to only one of the axes, wherein the third indicia include a plurality of first angular lines each having a first end positioned along the second axis and near a perimeter of the mat.

10. The mat of claim 9 further comprising a fourth indicia that is positioned on the first surface, the fourth indicia being positioned symmetrically relative to only one of the axes, wherein the fourth indicia include a pair of sinusoidal waves that extend along and are centered about the first axis.

11. The mat of claim 1 further comprising a third indicia that is positioned on the first surface, the third indicia being positioned symmetrically relative to only one of the axes, wherein the third indicia include a pair of sinusoidal waves that extend along and are centered about the first axis.

12. A mat comprising:

a first surface that is substantially rectangular in shape, the first surface including a first end, an opposed second end, a first side, an opposed second side, a first axis and a second axis that is orthogonal to the first axis;

a plurality of longitudinal lines that extend substantially from the first end to the second end, the plurality of longitudinal lines being substantially parallel to one another, the plurality of longitudinal lines including (i) a longitudinal centerline including a first identifier, (ii) a pair of first longitudinal lines that are equally spaced on either side of the longitudinal centerline, the first longitudinal lines including a second identifier that is different than the first identifier, (iii) a pair of second longitudinal lines that are equally spaced on either side of the longitudinal centerline, the pair of second longitudinal lines including a third identifier that is different than the first identifier and the second identifier, and (iv) a pair of third longitudinal lines that are equally spaced on either side of the longitudinal centerline, the pair of third longitudinal lines including a fourth identifier that is different than the first identifier, the second identifier and the third identifier;

a plurality of transverse lines that are substantially equally spaced apart from and substantially parallel to one another, the plurality of transverse lines being substantially perpendicular to the plurality of longitudinal lines, the plurality of transverse lines including at least a transverse centerline that intersects with the longitudinal centerline to define an origin at a geometric center of the mat;

a plurality of radial lines that extend outwardly away from the origin toward a perimeter of the mat, the radial lines being positioned symmetrically relative to the origin;

a pair of first symbols that are positioned on the first surface, the first symbols being positioned symmetrically relative to the origin, each of the first symbols being positioned along one of the radial lines;

at least three concentric circles having a center that is positioned away from the geometric center of the mat;

a discontinuous fourth concentric circle having a portion that extends adjacent to a perimeter of the mat;

a plurality of first angular lines each having a first end positioned along the second axis and near the perimeter of the mat along the first side;

a plurality of second angular lines each having a first end positioned along the second axis and near the perimeter of the mat along the second side; and a pair of sinusoidal waves that extend along and are centered about the first axis, the sinusoidal waves intersecting one another and being 180 degrees out of phase relative to one another.

13. A mat including a first surface, the first surface having a first axis and a second axis that is orthogonal to the first axis, the mat comprising:

an origin that is positioned along one of the axes;

a first indicia that is positioned on the first surface, the first indicia being positioned symmetrically relative to the origin; and a second indicia that is positioned on the first surface, the second indicia being positioned symmetrically relative to only one of the axes, the second indicia including a plurality of first angular lines each having a first end positioned along the second axis and near a perimeter of the mat.

14. The mat of claim 13 wherein adjacent first angular lines are spaced apart from one another by angles of approximately fifteen degrees.

15. The mat of claim 13 wherein the mat is substantially rectangular having a first side and an opposed second side, and wherein the plurality of first angular lines each have a first end positioned along the second axis and near the perimeter of the mat along the first side, the mat further comprising a plurality of second angular lines each having a first end positioned along the second axis and near the perimeter of the mat along the second side.

16. The mat of claim 13 wherein the first indicia include a plurality of longitudinal lines that extend substantially parallel to one another, the plurality of longitudinal lines including at least (i) a longitudinal centerline, (ii) a pair of first longitudinal lines that are equally spaced on either side of the longitudinal centerline, (iii) a pair of second longitudinal lines that are equally spaced on either side of the longitudinal centerline, and (iv) a pair of third longitudinal lines that are equally spaced on either side of the longitudinal centerline.

17. The mat of claim 13 further comprising a third indicia that is positioned on the first surface, the third indicia being positioned symmetrically relative to only one of the axes, wherein the third indicia include a pair of sinusoidal waves that extend along and are centered about the first axis.

18. A mat including a first surface, the first surface having a first axis and a second axis that is orthogonal to the first axis, the mat comprising:

an origin that is positioned along one of the axes;

a first indicia that is positioned on the first surface, the first indicia being positioned symmetrically relative to the origin; and a second indicia that is positioned on the first surface, the second indicia being positioned symmetrically relative to only one of the axes, the second indicia including a pair of sinusoidal waves that extend along and are centered about the first axis.

19. The mat of claim 18 wherein the sinusoidal waves intersect one another and are approximately 180 degrees out of phase relative to one another.

20. The mat of claim 18 wherein the sinusoidal waves cooperate to form a plurality of ellipse-type shapes on the first surface, wherein a longitudinal center of a middle ellipse-type shape is located at the origin, and wherein the origin is defined along the first axis between a first edge and an opposed second edge of the mat such that a ratio of a first distance from the first edge to the second edge to a second distance from the first edge to the origin is approximately equal to a golden ratio of 1.618:1.

21. The mat of claim 18 wherein the first indicia include a plurality of longitudinal lines that extend substantially parallel to one another, the plurality of longitudinal lines including at least (i) a longitudinal centerline, (ii) a pair of first longitudinal lines that are equally spaced on either side of the longitudinal centerline, (iii) a pair of second longitudinal lines that are equally spaced on either side of the longitudinal centerline, and (iv) a pair of third longitudinal lines that are equally spaced on either side of the longitudinal centerline.

* * * * *